US005914171A

United States Patent [19]

Morley

[11] Patent Number: 5,914,171

[45] Date of Patent: Jun. 22, 1999

[54] EDGE PROTECTOR, METHOD AND FITTED ARTICLE

[75] Inventor: Timothy Corben Morley, Birmingham, United Kingdom

[73] Assignee: Aston Packaging, Ltd., United Kingdom

[21] Appl. No.: 08/945,010

[22] PCT Filed: Feb. 14, 1997

[86] PCT No.: PCT/GB97/00408

§ 371 Date: Oct. 14, 1997

§ 102(e) Date: Oct. 14, 1997

[87] PCT Pub. No.: WO97/29958

PCT Pub. Date: Aug. 21, 1997

[30] Foreign Application Priority Data

Feb. 16, 1996 [GB] United Kingdom ..... 9603286

[51] Int. Cl.[6] ..... B32B 3/04

[52] U.S. Cl. ..... 428/122; 428/182; 428/358

[58] Field of Search ..... 428/121, 122, 428/124, 182, 358

[56] References Cited

U.S. PATENT DOCUMENTS

| | | | |
|---|---|---|---|
| 884,256 | 4/1908 | Addie | 24/546 X |
| 1,482,132 | 1/1924 | Guillaume | 428/122 |
| 1,491,286 | 4/1924 | Calhoun | 24/457 X |
| 2,068,771 | 1/1937 | Sherman | 206/586 |
| 2,507,929 | 5/1950 | Pennebaker | 206/586 |
| 3,244,347 | 4/1966 | Jenk | 206/586 |
| 3,300,168 | 1/1967 | Gaudino | 248/231.81 X |
| 3,816,225 | 6/1974 | Eckel | 428/122 |
| 4,261,091 | 4/1981 | Mulkins | 248/345.1 X |
| 4,813,107 | 3/1989 | Cetrone | 24/489 X |
| 5,604,011 | 2/1997 | Morley | 428/122 |

FOREIGN PATENT DOCUMENTS

| | | |
|---|---|---|
| WO94/04430 | 3/1994 | WIPO . |
| WO96/02435 | 2/1996 | WIPO . |

*Primary Examiner*—Henry F. Epstein

*Attorney, Agent, or Firm*—Steven J. Hultquist; William A. Barrett

[57] ABSTRACT

The invention relates to an edge protector, method and fitted article, and in particular to an edge protector for use on generally flat faced, panel-like products such as doors, worktops, table-tops and the like. There is disclosed an edge protector (10) having a base (14), two opposed sides (16), each side including a leg (20) and an arm (22), the legs and arms comprising corrugated paper joined to plain paper, characterised in that the arms (22) extend between the legs (20), and in that the plain paper on tan arm faces plain paper on the other arm and in that plain paper on a leg faces away from plain paper on the other leg. There is further disclosed such edge protector wherein the legs and arms are of paper having fluting on one face and include resilient biassing means (24) acting to urge parts of the respective sides towards each other. There is also disclosed a method for making such an edge protector and an edge protector fitted therewith.

13 Claims, 2 Drawing Sheets

EDGE PROTECTOR, METHOD AND FITTED ARTICLE

FIELD OF THE INVENTION

This invention relates to an edge protector and fitted article, and relates in particular to an edge protector for use on generally flat faced edges, such as provided on panel-like products such as doors, worktops, tabletops and the like (herein referred to as articles, and to such articles fitted with an edge protector.

BACKGROUND OF THE INVENTION

During or following manufacture it is customary for several articles as defined above to be laid horizontally, to await removal to the next manufacturing stage, to be taken to store, or to be made ready for delivery to a customer.

If the articles are stacked horizontally one above another, particularly if held in long-term storage, and are shaped so that they engage only at an edge they may sag or warp, and it is therefore desirable that the articles be stacked closely so that the degree of sagging of an article can perhaps be limited by the article below. Furthermore, if stack height is critical, then if articles are more closely stacked extra articles can be stored or be transported "as a stack".

The peripheral edges of articles are at risk from damage both during storage and transportation, and it is customary for the manufacturer, and often also the customer, to require article edge protection of an adequate thickness designed to reduce the likelihood, and/or severity, of any such damage.

It will be understood that although a desired edge protector shape may readily nowadays be formed in a plastic material, users are increasingly conscious of the environmental implications and the public reaction to the plastics disposal problem, particularly for "one trip" packaging materials. Many currently available edge protectors are manufactured from moulded polystyrene or polyethylene, but users have for some years been actively seeking environmentally acceptable alternatives; specifically, in a technical area in which recycled or recyclable materials may easily be employed, many manufacturers and users are increasingly resisting the use of materials which are not and/or may not be recycled, and instead would prefer to use recycled materials if of the same or similar cost and performance.

A known recyclable material is corrugated paper, and a convenient form of this is single-faced corrugated paper in which one corrugated sheet is adhered at corrugation peaks to a sheet of substantially planar paper.

DISCLOSURE OF THE PRIOR ART

Many currently available edge protectors are formed with fold-lines as "U-section" lengths, designed so that the sides of the "U" lie between adjacent stacked articles, whilst the base of the "U" fits alongside, and so provides protection for, the peripheral edge.

U.S. Pat. No. 3,335,932 discloses a "U-section" edge protector of recycled or recyclable material. The edge protector is of multi-layered paper, with therefore the sides of the "U" being of similar thickness to that of the base. This edge protector can thus satisfy the first requirement of many users, that the edge protector be recycled and/or recyclable.

U.S. Pat. No. 2,068,771 discloses an edge protector of "L-section", which is manufactured as a "U-section" and then cut in two. The edge protector is manufactured from multi-layer corrugated board (i.e. a sheet of corrugated paper lies between two sheets of substantially planar paper). In a modified arrangement, with the "U-section" formed from a single piece of folded (semi-rigid) cardboard, adjacent to the base and extending between the opposed sides are added (three) further layers of semi-rigid cardboard, whereby to thicken the base as compared to the side walls.

The edge protector of U.S. Pat. No. 2,068,771 can thus satisfy the second requirement of many users in that the sides are relatively thin so as to permit the close stacking of articles. However, the sides of the U-section are substantially fixed, so that their use is intended for articles with edges of uniform thickness or which vary from uniform thickness only within a small range. Alternatively stated, a given article thickness will require a suitably-mixed edge protector, so that several differing sizes of edge protector may need to be produced if there is a range of edge thicknesses.

In our international application WO94/04430 we disclose an edge protector of "U-section", the edge protector being made of corrugated paper and having sides thinner than the base In one disclosed embodiment, the sides of the edge protector each comprise a leg and an arm joined thereto, the legs converging away from the base and the arms diverging away from the base. The legs have a certain degree of resilience, and so this edge protector can fit an article or articles with a larger range of thickness variation or difference. In addition, the diverging arms provide a lead-in, to facilitate fitting of the edge protector to an article.

Our application WO96/02435 discloses a hinged clip which can be used as an edge protector, in which the sides are resiliently biassed towards one another. Such an edge protector can fit an article or articles with an even larger range of thickness variation or difference. Our previously disclosed edge protectors can thus satisfy the third requirement of some users—that a specified protector can be fitted to an article of varying edge thickness, or to separate articles within a relatively broad range of thicknesses.

The edge protectors disclosed in WO94/04430 and WO96/02435 are generally made form single-faced corrugated paper, with the fluting of the corrugations of the sides facing inwardly or outwardly. We now realise that it is desirable for many users of such edge protectors that the surface which lies against the article being protected be the planar sheet rather than the corrugated sheet, otherwise dirt or debris which might be retained by the corrugations can contact and perhaps damage the article. This is of particular importance for the (inner) surface of the sides of the U-section, since in a high stack the weight of the articles above acts on these sides, and on any dirt or debris retained thereby. Thus, typically the corrugated paper of such a known edge protector has the planar sheet facing inwardly, and the corrugated sheet facing outwardly. In this way, any dirt or debris retained by the corrugations is remote from the article.

In a stack of articles having edge protectors in which the corrugations face outwardly, the corrugations of one edge protector may become enmeshed with the corrugations of an adjacent edge protector. If an article is to be removed from such a stack, and it is slid off rather than being lifted off, part or all of an enmeshed edge protector may remain with the stack, i.e. be stripped off the article.

Some users would benefit from a fourth requirement for an edge protector, which we have realized can be met if the edge protector has a flat, i.e. uncorrugated, surface adjacent both the article which it is desired to protect, and to the outside, so as substantially to prevent the corrugations of one edge protector becoming enmeshed with the corrugations of an adjacent edge protector, and so to reduce the likelihood of an edge protector being accidentally removed as above.

DISCLOSURE OF THE INVENTION

It is an object of the present invention to seek to satisfy the above four requirements, so as to prevent or reduce the disadvantages with the prior known edge protectors.

According to the invention we provide an edge protector having a base and two opposed sides, each side including a leg and an arm, the legs and arms comprising corrugated paper joined to plain paper, characterised in that the arms extend between the legs, and in that the plain paper on an arm faces plain paper on the other arm, and in that plain paper on a leg faces away from plain paper on the other leg.

Preferably the corrugated paper is joined to only one piece of plain paper so that the corrugated paper is single-faced; alternatively the corrugated paper may be in the form of board with two pieces of plain paper, one to either side of the corrugated paper.

We also provide an edge protector having a base, two opposed sides, and resilient biassing means acting to urge parts of the respective sides towards each other, each side including a leg and an arm, the legs and arms being of paper having fluting on one face, characterised in that the arms extend between the legs, and in that fluting on an arm faces fluting on its associated leg.

Preferably, the leg has a first border and a second border, the first border being connected to the base, the second border being connected to a respective arm. Preferably also, the base, legs and arms are formed from a single length of single-faced corrugated paper; in such a preferred embodiment an arm is connected to its leg by a fold in the said length, the fold providing the resilient biassing means.

Desirably, only the arms are resiliently biassed towards each other, the legs being relatively substantially fixed.

In the preferred embodiment in which an arm is connected to its leg by a fold, the parts which are biassed towards each other are the free edges of the arms, which preferably are adjacent the base.

Preferably, the arms have a combined length greater than the spacing between their joints with the respective legs, so that the arms are retained between the legs.

Conveniently, in the free state of the edge protector, the free of one of the arms engages the free edge of the other of the arms. The arms thus provide a tapered "lead-in" during fitting of the edge protector, and also help prevent dirt entering between an arm and a leg prior to fitting.

Usefully, further layers of corrugated paper are added to the base, to increase the degree of edge protection afforded. Usefully also, the further layers are secured to a part of each of the legs, substantially to fix the legs in relative position. The arms can be of a length such that when fitted to an article edge the arms contact the adjacent leg but not the further layers, or they can be of a length to contact the further layers.

We also provide an article having an edge fitted with an edge protector as herein defined.

We also disclose a method of making an edge protector from a sheet of corrugated paper having longitudinal side edges and with a sheet of plain paper affixed to one face of a sheet of corrugated paper which includes the steps of [i] forming a first pair of fold lines inwardly of the said edge and a second pair of fold lines inwardly of the said edges but outwardly of the said first pair of fold lines, the fold lines being substantially parallel, and [ii] folding the sheet about the fold liens to form a central panel, first panels connected to the central panel and second panels connected to respective first panels so that there is a first and second panel to opposite sides of the central panel, characterised by folding the second panels so that at least part of each said second panel lies between the first panels, and so that the plain paper on one second panel faces plain paper on the other second panel and so that plain paper on one first panel faces away from plain paper on the other first panel.

BRIEF DESCRIPTION OF THE DRAWINGS

The invention will be further described, by way of example, with reference to the accompanying drawings, in which.

DESCRIPTION OF THE PREFERRED EMBODIMENTS

Figure 1:
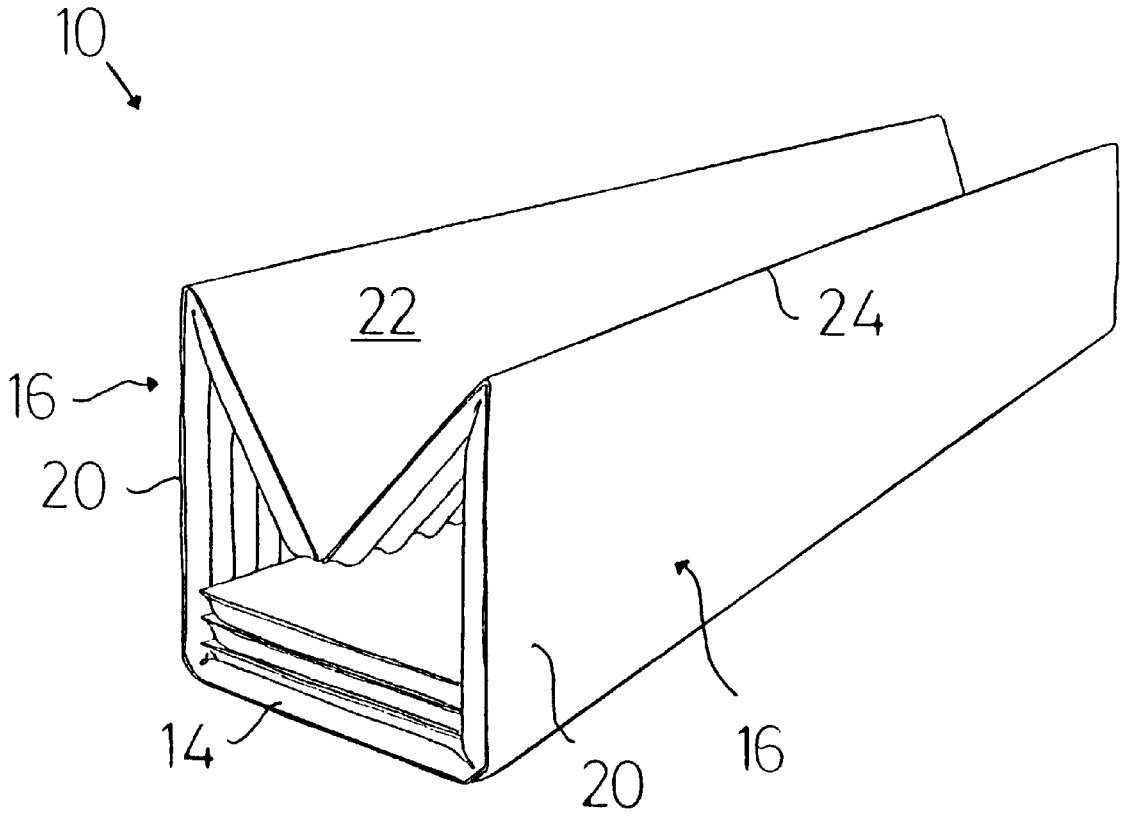
FIG. 1 is a perspective view of an edge protector according to the invention.
Figure 2:
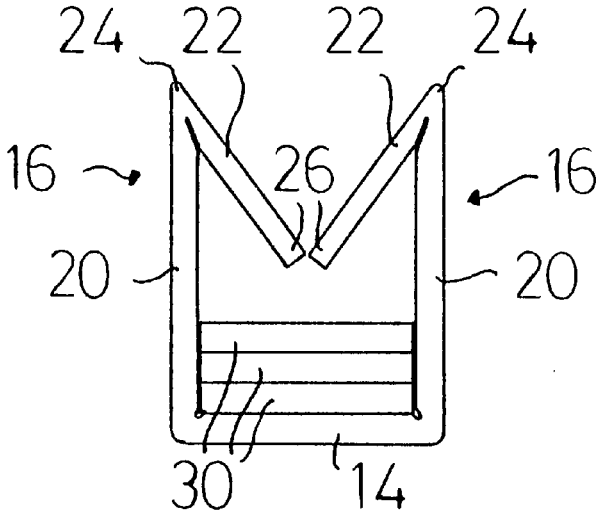
FIG. 2 is an end view of the edge protector of FIG. 1.

FIGS. 1 and 2 show the edge protector 10, which is produced from single-faced corrugated paper. As more clearly shown in FIG. 5 for the extra length of corrugated paper 46, single-faced corrugated paper comprises a corrugated or fluted sheet 47 adhered to a plain sheet 48.

The edge protector 10 includes a single sheet 12 (FIG. 3), bent substantially into a U-section with the exposed flutes running laterally around the U-section and facing inwardly. As seen in FIGS. 1, 2 the sheet 12 has been bent to provide a base 14 and two opposed sides 16.

The sides 16 each comprise a leg 20 and an inwardly depending arm 22. The leg 20 and arm 22 of a side 16 are joined by a respective fold line 24 which provides a border of the leg. The fold line 24 provide a resilient joint which acts to bias the free ends 26 of the arms 22 towards one another.

Between the legs 20 and the base 14 are affixed further layers of corrugated paper 30, which in this embodiment are also single-faced. Preferably there are three further layers of corrugated paper, though there may be a different number of further layers, in accordance with the degree of impact edge protection required.

The legs 20 are adhered to the further layers 30 (as described below), so that the legs are substantially fixed relative to the base 14, and so to each other.

Figure 3:
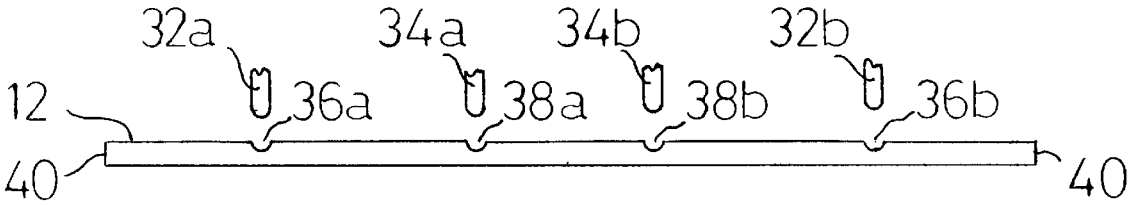
FIG. 3 is a schematic view of a first stage in the production of an edge protector similar to that of FIG. 1.
Figure 4:
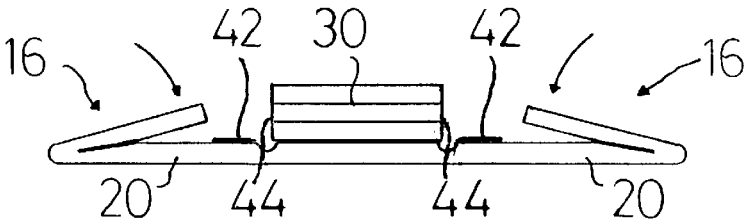
FIG. 4 is a schematic view of a later stage in the production.

FIGS. 3 and 4 show successive stages during the production process of the edge protector 10. In FIG. 3, a substantially flat sheet 12 of single-faced corrugated paper, with the corrugations facing upwardly, is presented (into the paper as viewed) to four creasing rollers 32*a*,34*a*,34*b*,32*b*. Outer rollers 32*a,b* comprise a first set of creasing rollers, which provide two crease lines 36*a*,36*b* (extending into the paper as viewed) and which will determine the position of the joint between a leg 20 and respective arm 22. The second set of (inner) creasing rollers 34*a,b* provide two crease lines 38*a*, 38*b* which will determine the position of the joint between the base 14 and the respective leg 20.

In FIG. 4, during the next stage of the production process, the side or terminal edges 40 of the sheet 12 (which form the free edges 26 in the finished edge protector) are folded or bent inwardly about the first crease lines 36*a* and 36*b* respectively, and are retained in the bent condition by known means. In a continuous production facility, the shaping of a channel within and along which the sheet 12 is moved can cause this inward folding and subsequent retaining of the edges 40, but in an alternative embodiment shaping rollers or their equivalent can be used, as will be clear to a person skilled in the art.

As also seen in FIG. 4 the required number of further layers 30 are then added to the base 14, either individually or as a preformed block, and are adhered thereto.

Part of the legs 20 are coated with adhesive 42 (suitably of latex or PVA), and the sides 16 are then inwardly folded (about second crease lines 38*a* and 38*b*) so that the coated part of each leg 20 contacts a side 44 of the further layers or block 30. The sides 16 are retained in position until the adhesive sets. Again, in a continuous production facility, the shaping out of the channel within and along which the sheet 12 is moved can effect the inward folding and subsequent retaining of the sides 16.

In an alternative embodiment, the adhesive is applied to the sides 44 of the further layers 30, and in another alternative embodiment the further layers 30 are adhered only to the legs 20, i.e. they are not adhered directly to the base 14.

If the edge protector is made in a continuous production facility, it may be cut to suitable lengths once the adhesive has set. If a customer has defined the lengths required, those lengths can be cut prior to dispatch to that customer; alternatively, lengths which are convenient to transport and handle, e.g. 2 m, may be cut and despatched ready to be cut to shorter lengths by the customer, as required. The base 14, legs 20 and arms 22 will be longitudinally-extending panels, as generally seen in FIG. 1.

In the drawings, the free ends 26 of the arms 22 are shown spaced apart for clarity, though in practice the resilience of the fold lines 24 will preferably be such that the free ends are in engagement in the free state of the edge protector.

It will be understood by those skilled in the art that the resilience of the fold lines 24 depends upon the thickness of the paper from which the sheet 12 is made, and also upon the degree to which (and perhaps the duration for which) the arms 22 are held in the "overbent" condition of FIG. 4. Since this resilience determines the degree of frictional grip with an article edge, the variables mentioned above can be altered as desired. In one alternative method of manufacture, for example, the arms 22 may be bent inwardly immediately prior to the sheet 12 being bent about the second crease lines 38*a,b*, and may be bent inwardly just sufficiently to permit the legs 20 to be adhered to the further layers.

Figure 5:
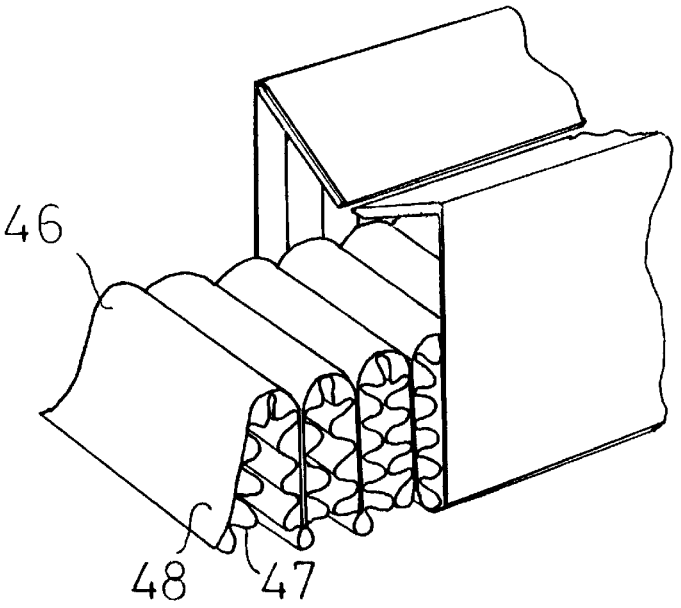
FIG. 5 is a perspective view of an alternative embodiment of edge protector.

Other alternative designs could utilize different forms of corrugated paper as the "further layers" to add to the base. Thus, the further layers could be formed from a single length of corrugated paper which is wider than the spacing between the sides 16, and which is folded (along lines parallel to the crease/fold lines of the edge protector) to provide the required number of further layers. Alternatively, and as shown in FIG. 5, a single length of corrugated paper 46 is folded upon itself in concertina fashion. In one embodiment the length of corrugated paper 46 is folded as it is added to the base 14, though in another embodiment it is preformed and supplied as a ready-made "further layer" or filler piece.

It will be understood that the combined "length" of the arms (i.e. that dimension between the fold line 36*a,b* and the respective free end 26) is large enough so that the arms 22 abut each other and are retained between the legs. Preferably, the length of the arms is substantially equal to the "free length" of the legs (i.e. that dimension between the fold lines 36*a,b* and the topmost further layer) so that when fitted to an article the "exposed" corrugations of a leg (not covered by the further layers) are completely or substantially covered by its associated arm. However, we do not discount the possibility of an arm length greater than the "free length" of the leg, so that when fitted to an article the arm is bent against the base or further layers adjacent its free end, e.g. to ensure full covering of the fluting for articles with edges of varying or differing thickness. Neither do we discount the possibility of an arm length shorter than the "free length" of the leg, so that when fitted to an article there remains some exposed fluting adjacent the article. Whilst this latter embodiment is less desirable, the exposed fluting will be considerably less than in the prior art edge protectors, and the likelihood of dirt or debris entering between the arms during transportation, for example, is reduced by the abutment of the free ends of the arms.

It will also be understood that in the preferred embodiment as shown in the drawings, the arms provide a tapered lead-in for the article. This lead-in has a similar function to that disclosed in WO94/04430, but since in the present case it is between the legs it is less liable to damage during e.g. transportation.

An edge protector according to embodiments of the invention can therefore provide the following features:

- maximum edge protection, by adding the required number of further layers to the base without compromising stack height;
- double-layer sides, which increase the protection between adjacent articles;
- a substantially smooth inner surface, which reduces the likelihood of dirt or debris being retained adjacent the article;
- a substantially smooth inner surface, which together with a tapering lead in aids the fitting of the protector to an article;
- resilient biassing of the sides, which helps the protector to "grip" frictionally the edge to be protected;
- resilient biassing of the sides, which enables the protector to be fitted to an edge of varying thickness, and enables one size of protector to fit a range of edge thicknesses;
- unitary base and sides of a recyled and/or recyclable material.

I claim:

1. An edge protector having a base and two opposed sides, each side including a leg and an arm, the legs and arms comprising corrugated paper joined to plain paper, wherein the arms extend between the legs, and wherein plain paper on an arm faces plain paper on the other arm and plain paper on a leg faces away from plain paper on the other leg.

2. An edge protector having a base, two opposed sides, and resilient biassing means acting to urge parts of the respective sides towards each other, each side including a leg and an arm, the legs and arms being of paper having fluting on one face, wherein the arms extend between the legs, and wherein fluting on an arm faces fluting on its associated leg.

3. An edge protector according to claim 2 wherein each leg has a first border and a second border, the first border being connected to the base, the second border being connected to a respective arm.

4. An edge protector according to claim 2 wherein the base, legs and arms are formed from a single length of single-faced corrugated paper.

5. An edge protector according to claim 4 wherein each arm is connected to its leg by a respective fold in the said length, the fold providing said resilient biasing means.

6. An edge protector according to claim 5 wherein the arms have a combined length greater than the spacing between the folds, so that the arms are thereby retained between the legs.

7. An edge protector according to claim 2 wherein the said parts which are biassed towards each other include the free edges of the arms, and wherein the said free edges can contact the base.

8. An edge protector according to claim 7 wherein the free edge of one of the arms can engage the free edge of the other of the arms, such that the engaged free edges help to prevent dirt from entering between an arm and a leg prior to fitting of the edge protector to an article edge, and such that the arms can provide a tapered lead-in during fitting of the edge protector to an article edge.

9. An edge protector according to claim 2 wherein further layers of corrugated paper are added to the base, between the legs, whereby to increase the degree of edge protection afforded.

10. An edge protector according to claim 9 wherein the further layers are secured to a part of each of the legs so as to fix the legs in position relative to the base and to each other.

11. An article having an edge fitted with an edge protector according to claim 10 wherein the arms contact the adjacent leg but do not contact the further layers.

12. An article having an edge fitting with an edge protector according to claim 9 wherein the arms contact the adjacent leg but do not contact the further layers.

13. An edge protector having a base and two opposed sides, each side including a leg and an arm, the legs and arms comprising corrugated paper joined to plain paper, wherein the arms extend between the legs wherein the plain paper on an arm faces plain paper on the other arm and plain paper on a leg faces away from plain paper on the other leg and wherein a resilient joint is provided between each arm and its respective leg.

* * * * *

UNITED STATES PATENT AND TRADEMARK OFFICE

CERTIFICATE OF CORRECTION

PATENT NO. :5,914,171
DATED :June 22, 1999
INVENTOR(S) :Timothy Corben Morley

It is certified that error appears in the above-identified patent and that said Letters Patent is hereby corrected as shown below:

| | |
|---|---|
| Column 1, line 9: | "articles, and" should be - -articles), and- - |
| Column 2, line 14: | "suitably-mixed" should be - -suitably-sized- - |
| Column 2, line 40: | "form" should be - -from- - |
| Column 3, line 64: | "edge" should be - -edges- - |
| Column 4, line 1: | "liens" should be - -lines- - |
| Column 8, line 8: | "fitting" should be - -fitted- - |

Signed and Sealed this

Twenty-eighth Day of March, 2000

*Attest:*

Q. TODD DICKINSON

*Attesting Officer*

*Commissioner of Patents and Trademarks*